United States Patent [19]

Dimmick

[11] 4,439,070

[45] Mar. 27, 1984

[54] METHOD FOR RESTORING AN UNDERWATER PILING AND AN UNDERWATER JACKET USED THEREWITH

[76] Inventor: Floyd E. Dimmick, 109 Brinker Rd., Barrington Hills, Ill. 60010

[21] Appl. No.: 285,964

[22] Filed: Jul. 23, 1981

[51] Int. Cl.[3] ..... E02D 5/60

[52] U.S. Cl. ..... 405/216; 24/271; 52/725

[58] Field of Search ..... 405/211, 216, 231; 24/170, 179, 270, 271, 280; 52/725, 727, 728, 743, 744

[56] References Cited

U.S. PATENT DOCUMENTS

| | | | |
|---|---|---|---|
| 1,629,246 | 5/1927 | Arrington | 24/280 |
| 2,482,374 | 9/1949 | Ruschmeyer | 24/271 |
| 3,238,581 | 3/1966 | Sawyer | 24/271 X |
| 3,524,231 | 8/1970 | Wiswell | 405/216 X |
| 3,690,110 | 9/1972 | Wiswell | 405/216 |
| 4,306,821 | 12/1981 | Moore | 405/216 |

FOREIGN PATENT DOCUMENTS

| | | | |
|---|---|---|---|
| 1494072 | 12/1977 | United Kingdom | 405/216 |
| 2028405 | 3/1980 | United Kingdom | 405/216 |
| 1585627 | 3/1981 | United Kingdom | 405/216 |

*Primary Examiner*—David H. Corbin
*Attorney, Agent, or Firm*—Thomas R. Vigil

[57] ABSTRACT

The method for restoring an underwater wood, concrete or steel piling or other underwater structure includes the steps of: placing a jacket around a portion of a piling to be restored; securing the jacket in place around the piling so as to create a closed, annular space between the piling and the jacket; injecting, in at least one location at the lower end of the annular space, an epoxy resin composition into the annular space while at the same time venting the annular space in at least one location at the upper end of the annular space until the epoxy resin composition begins to escape from the upper end of the annular space. The underwater injection jacket comprises a sheet of flexible material having an upper edge and a lower edge and which is coilable into a generally cylindrically shaped jacket about an underwater piling with first and second mating edges of the sheet adapted to be secured in place relative to each other to form the jacket about the piling. A first sealing strip is provided along the lower edge of the sheet and a second sealing strip is provided along the upper edge of the sheet for establishing lower and upper annular seals between the jacket formed by the sheet and the piling when the mating edges are secured in place thereby forming a closed annular space within the jacket. A clamping system is provided for securing the mating edges in place relative to each other and in a sealed manner. The jacket also has inlet ports for the injection of epoxy resin into the annular space and venting ports for venting water from the annular space. Additionally, two semi-annular space portions can be formed so that epoxy resin composition can be injected into one side of the jacket while a vacuum is drawn on the other side of the jacket to seal cracks within the piling.

46 Claims, 13 Drawing Figures

FIG. 4
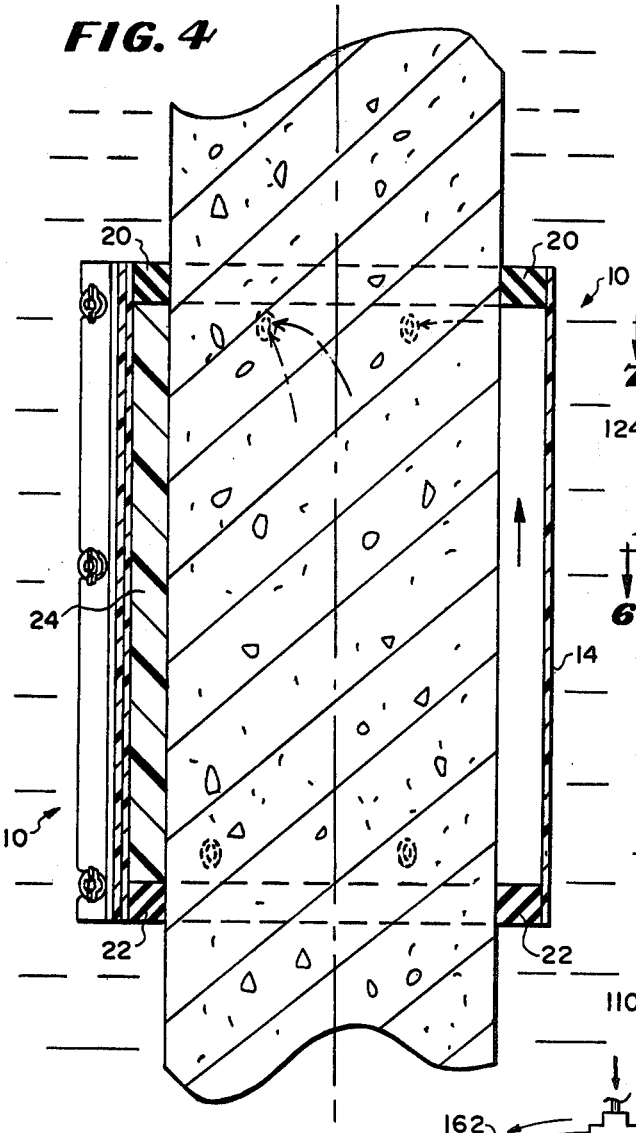
FIG. 5
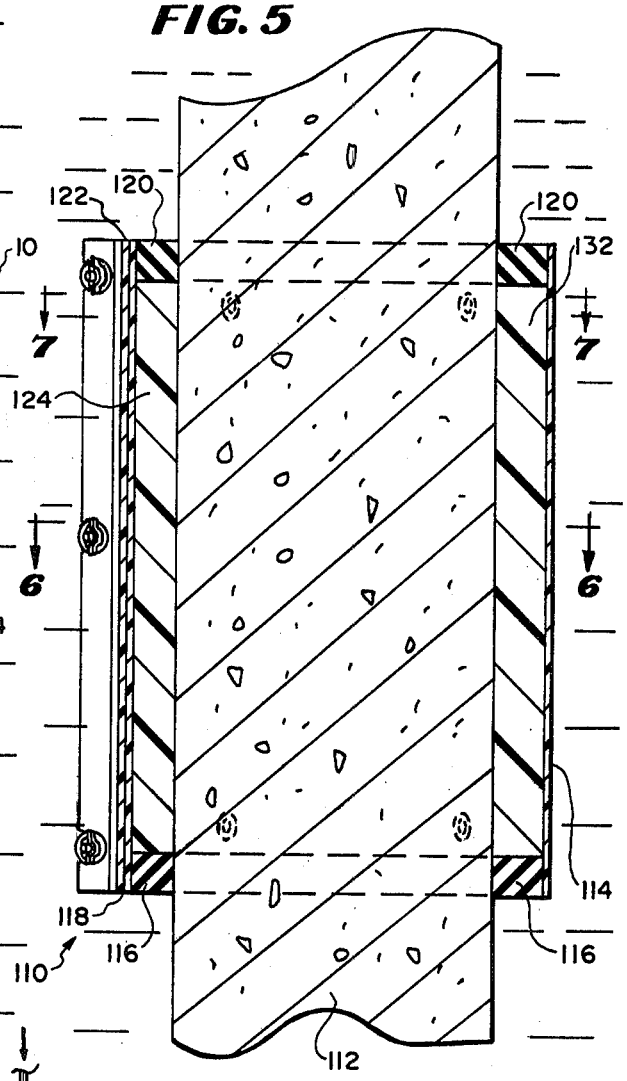
FIG. 6
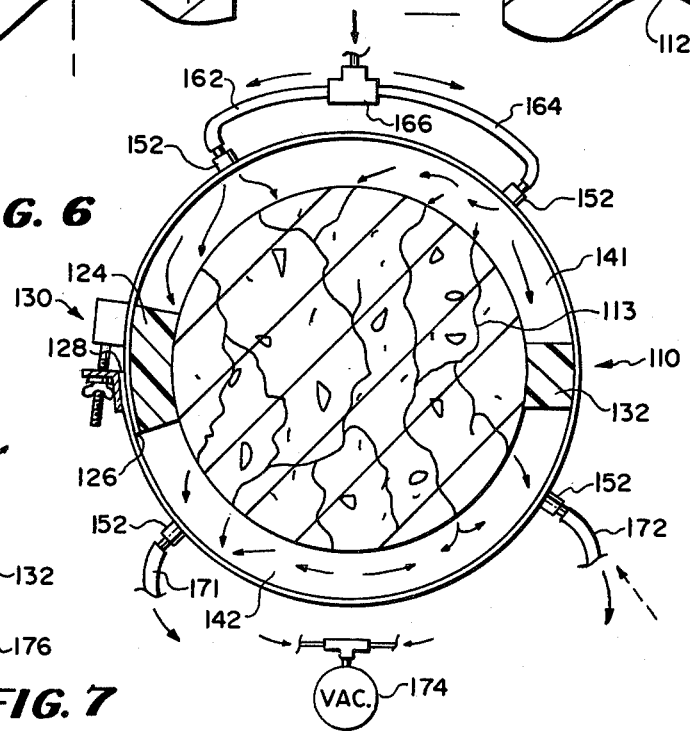
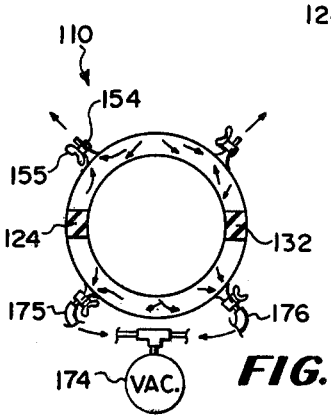
FIG. 7

METHOD FOR RESTORING AN UNDERWATER PILING AND AN UNDERWATER JACKET USED THEREWITH

BACKGROUND OF THE INVENTION

1. Field of the Invention

The present invention relates to a method for restoring underwater pilings such as concrete, wood and steel pilings, and other underwater structures and to an underwater injection jacket specifically designed for use with and for carrying out the method.

2. Description of the Prior Art

Heretofore various techniques have been provided for forming an encasement or jacket around a deteriorated underwater piling with a worn or corroded surface and/or with cracks therein. Such techniques have typically involved forming a concrete jacket around the piling. Examples of such prior art method and apparatus for encasing an existing underwater piling in a concrete jacket are disclosed in the following U.S. patents:

| U.S. PAT. NO. | PATENTEE |
|---|---|
| 518,354 | Polhamus |
| 1,025,112 | Davis |
| 2,412,185 | Weber |

Also it has been proposed to establish a jacket of asphalt around a concrete piling in the Osborne U.S. Pat. No. 1,814,332.

More recently it has been proposed in the Shaw, et al. U.S. Pat. No. 3,719,049 to provide a splash zone corrosion proofing means comprising a flexible membrane made of synthetic rubber, neoprene, chlorosulfonated polyethylene, etc. which is fitted around a portion of a piling to be protected and then closed with a slide fastener such as a zipper fastening means. Once the membrane has been mounted in place, a cavity is defined between the membrane and the piling and this cavity is then filled with an inhibitor such as a petroleum base hydrophobic cationic rust-inhibiting material.

Still further, it has been proposed to provide in the Wiswell, Jr. U.S. Pat. No. 3,553,970 an inflatable clamping device around a piling for applying a a plastic or epoxy resin to the piling. This patent discloses an inflatable device made of a fluid-impervious flexible inflatable material into which is inserted a plastic or resin, and preferably an epoxy resin, which is mixed with a curing agent. This patent teaches a means for maintaining a desired temperature and pressure within the inflatable device to ensure proper curing of the plastic or resin composition therein.

As will be described in greater detail hereinafter, the underwater injection jacket of the present invention differs from the inflatable clamping device disclosed in the Wiswell, Jr. patent by providing a sheet of flexible but stiff material which is coiable into a jacket that can be of any desired size around a portion of a piling of any size and which has simple means for drawing the margins of the mating edges of the sheet toward one another to provide a tight jacket around the piling with a closed annular space formed between the piling and the jacket.

Also as will be described in greater detail hereinafter, the method of the present invention differs from the method disclosed in the Wiswell Jr. patent by providing a method for the injection of an epoxy resin composition without maintaining a special pressure or temperature on the epoxy resin composition and for injecting a special epoxy resin composition, and for not only filling the annular space formed within the jacket but also for drawing epoxy resin into the cracks in the piling such as cracks in a concrete piling. The special epoxy resin composition utilized in the method of the present invention cures, sets and bonds to wet substrates at temperatures as low as 33° F. and to dry substrates at temperatures as low as 0° F.

Other differences between applicant's method and underwater injection jacket utilized in practicing such method will be apparent from the detailed description of the invention set forth in greater detail below.

SUMMARY OF THE INVENTION

According to the invention there is provided a method for restoring an underwater concrete, wood or steel piling or other underwater structure including the steps of: placing a sheet of plastic material around a portion of a piling to be restored with longitudinal edges of the sheet overlapping each other and with at least one strip of compressible material situated between the lower edge of the sheet and the piling; applying an epoxy composition either to the inner surface of the strip of compressible material and/or the adjacent piling; drawing the longitudinal edges of the sheet in further overlapping relationship; fixing the drawn together edges in place to form a jacket around the piling and to create an annular space between the piling and the jacket; injecting an epoxy composition into said annular space while at the same time venting said annular space in at least one location at the upper end of said annular space until said epoxy composition begins to escape from said at least one location at the upper end of said annular space.

Further, according to the invention there is provided an underwater injection jacket comprising a sheet of flexible plastic material having an upper edge and a lower edge and which is coilable into a jacket around an underwater piling with first and second mating and overlapping edges of said sheet adapted to be secured in place in overlapping relationship relative to each other to form said jacket about the piling, first compressible sealing means along said lower edge of said sheet for establishing a lower annular seal between said jacket formed by said sheet and the piling when said mating edges are secured in place in overlapping relationship relative to each other thereby to form a close annular space within said jacket clamping means for clamping said mating edges in place in overlapping relationship relative to each other and in a sealed manner, said clamping means comprising adjustable spring biased means for drawing the opposed longitudinal edges of the sheet of plastic material together in overlapping relationship to each other and means for securing the drawn together overlapping edges in place.

BRIEF DESCRIPTION OF THE DRAWINGS

FIG. 4 is an angular vertical sectional view taken along line 4—4 of FIG. 3.

FIG. 5 is a vertical sectional view of another embodiment of the jacket of the present invention.

FIG. 6 is a sectional view of the jacket shown in FIG. 5 taken along line 6—6 of FIG. 5.

FIG. 7 is a reduced-in-size, sectional view of the jacket shown in FIG. 5 taken along line 7—7 of FIG. 5.

DESCRIPTION OF THE PREFERRED EMBODIMENT

Figure 1:
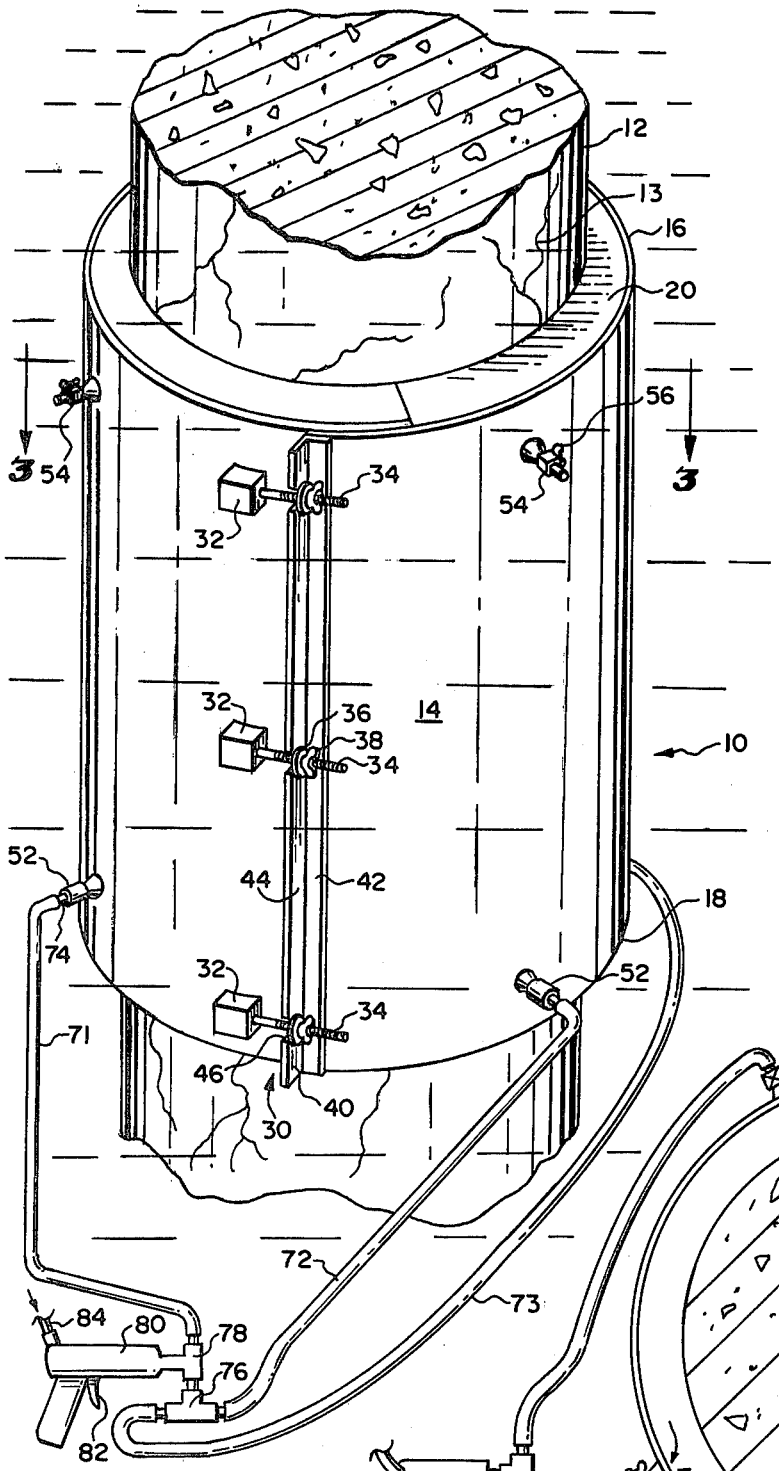
FIG. 1 is a vertical perspective view of the underwater injection jacket of the present invention clamped about a portion of an underwater piling and connected to an injection gun for carrying out the method of the present invention.

Referring now to FIG. 1 there is illustrated therein an underwater injection jacket 10 constructed and assembled in accordance with the teachings of the present invention. The jacket 10 is shown secured in place around a portion of an underwater concrete column 12 having cracks 13 therein which are to be sealed utilizing the method of the present invention to be described in greater detail hereinafter. The jacket 10 is made from a generally rectangular coilable sheet of flexible material 14 which is typically a clear or colored plastic material having a thickness of approximately 0.060 inch. The material from which the sheet 14 is made can be chosen from the class consisting of ABS, PVC and plexiglass. Such material is relatively stiff but still sufficiently flexible so that it can be bent or coiled.

The sheet 14 and jacket 10 formed therewith has an upper edge 16 and a lower edge 18. As shown in FIG. 1, a strip of sealing material 20 is secured to the inner marginal surface of the sheet 14 adjacent the upper edge 16 so that when the sheet 14 is coiled around the piling 12, the sealing strip 20 forms a sealing ring. Likewise, and as shown in FIG. 4, another sealing strip 22 is secured to the inner marginal surface area of the sheet 14 adjacent the lower edge 18 so as to form a lower seal when the sheet 14 is coiled around the piling 12 to form the jacket 10.

Figure 3:
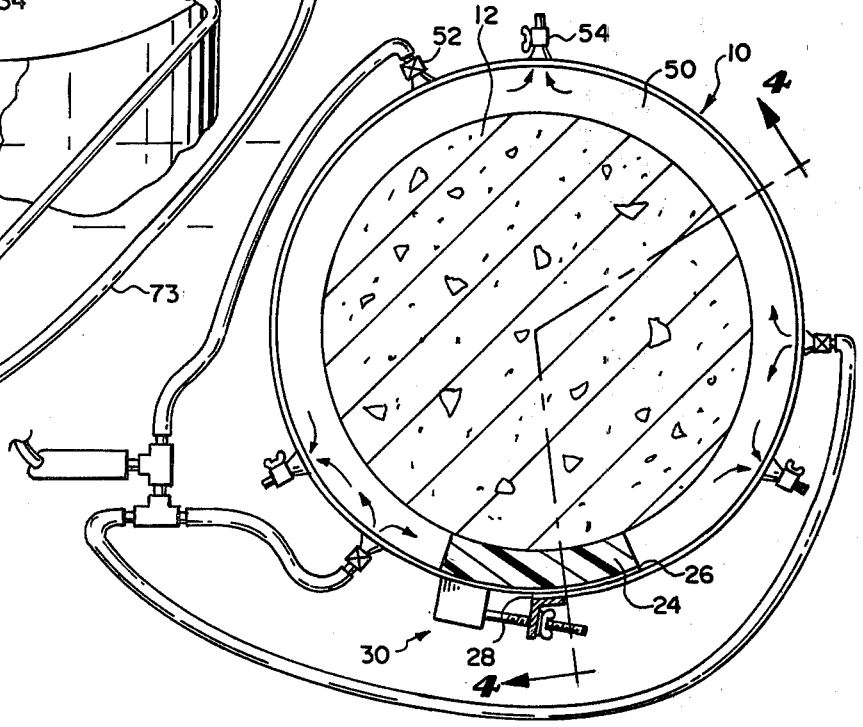
FIG. 3 is a horizontal sectional view taken along line 3—3 of FIG. 1.

Also, and as best shown in FIGS. 3 and 4, the jacket 10 can be provided with an elongate sealing strip 24 which is secured to the inner marginal surface area adjacent a first mating edge 26 of the sheet 14. The sealing strips 20, 22 and 24 are all made of a compressible foam material such as polyetheylene or ethylenevinyl acetate.

A second or other mating edge 28 of the sheet 14, when it is coiled about the piling 12, and the margin adjacent the edge 28 overlap the edge 26 and the margin adjacent thereto as shown in FIGS. 1 and 4. Mounted on these margins adjacent the mating edges 26 and 28 for securing the margins together with the mating edges secured in place relative to each other is a clamping system 30.

In the embodiment shown in FIGS. 1–4 the clamping system 30 consists of three blocks 32 which are secured to the sheet 14 and spaced a short distance from the first mating edge 26. Extending from each block 32, which is glued or otherwise adhered to the sheet 14, is a threaded rod 34. Each threaded rod 34 has a washer 36 and wing nut 38 received thereon and the distal end of the rod 34 is stripped to prevent the wing nut 38 from coming off the threaded rod 34.

The clamping system 30 further includes a bar or angle iron 40 having an L shaped cross section with side 42 thereof fixed to the margin adjacent the second mating edge 28 with the other side 44 thereof extending outwardly from the jacket 10 flush with the second mating edge 28. Also the side 44 has three slots 46 therein each of which is adapted to receive one of the threaded rods 34 therein so that the wing nuts 38 can be threaded on the rods 34 against the side 44 so as to draw the mating edge 28 and adjacent margin over the first mating edge 26 and adjacent margin as best shown in FIG. 3. In this way, the clamping system 30 permits an underwater diver to easily move the threaded rods 34 into the slots 46 for effecting clamping of the sheet 14 around a piling 12 and to provide a tight, overlapping, snug fit of the marginal areas adjacent the mating edges 26 and 28 to form the jacket 10.

Figures 8, 9, 9A, 10, 11, 12:
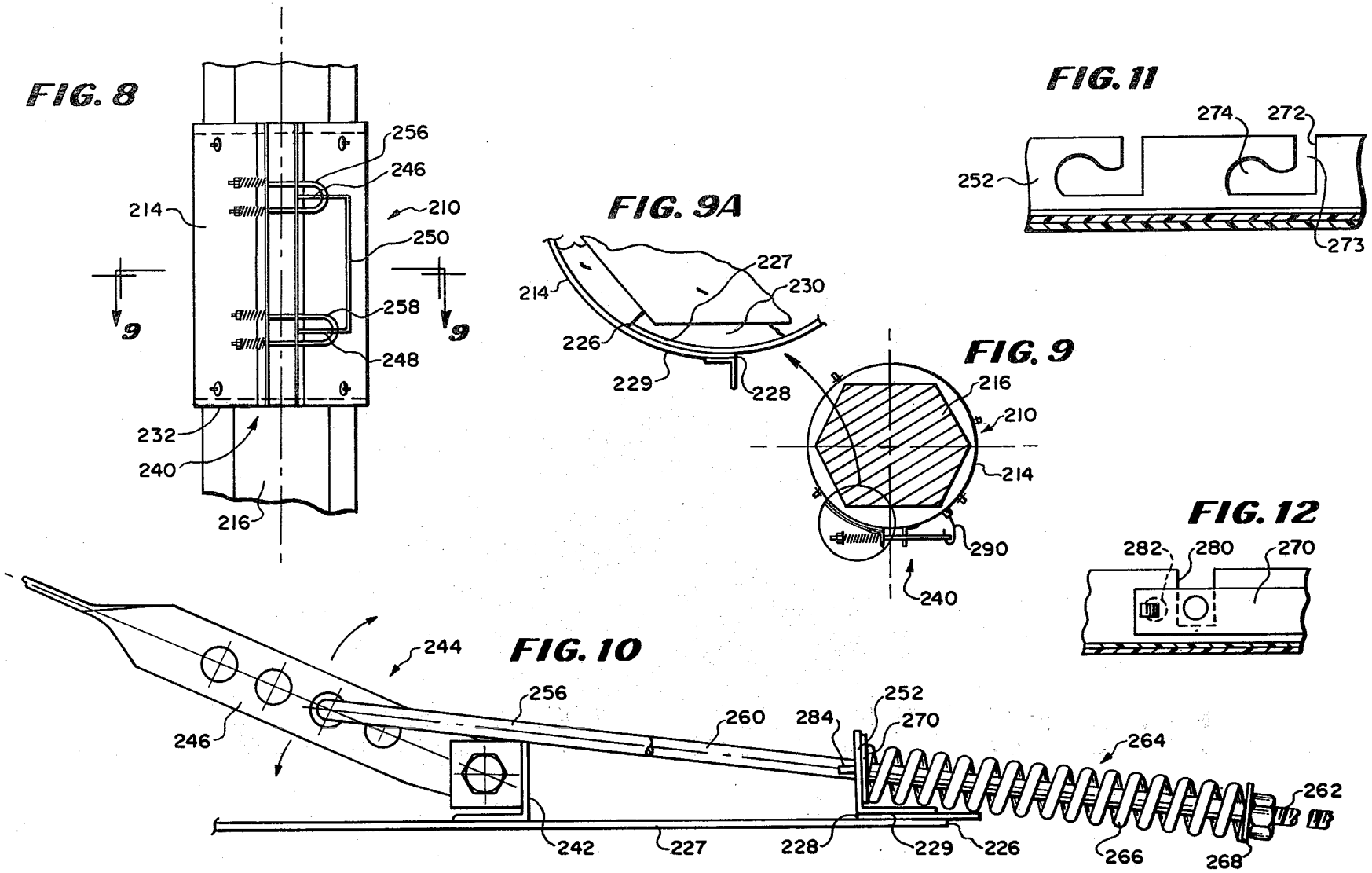
FIG. 8 is a vertical elevational view of another embodiment of the underwater injection jacket of the present invention.
FIG. 9 is a sectional view of the jacket shown in FIG. 8 taken along line 9—9 of FIG. 8.
FIG. 9A is an enlargement of a portion of the jacket shown in FIG. 9 and shows the overlapping engagement of the margins adjacent the mating edges of the flexible, coilable sheet of material from which the jacket is formed.
FIG. 10 is an enlarged view of the clamping system utilized with the jacket shown in FIG. 9 with portions broken away.
FIG. 11 is a fragmentary vertical sectional view of one of the clamping system with L shaped slots therein and is taken along line 11—11 of FIG. 10.
FIG. 12 is a fragmentary vertical elevational view, similar to FIG. 11, of another embodiment of one bar of the clamping system with U shaped slots therein.

If desired, the notches 46 can be formed in an L shape such as the L shape shown for the notches illustrated in FIG. 11 for the bar of angle iron used in another embodiment of the jacket of the present invention.

In assembling the sheet 14 around the piling 12 to form the jacket 10, the sheet 14, which is in a generally coiled shaped but with the mating edges 26 and 28 spaced apart, is fitted about a portion of a piling such as the concrete piling 12 and the clamping system is brought together with the rods 34 received in the slots 46 and the wing nuts 38 threaded down to draw the marginal area adjacent the edge 28 over the edge 26 as shown with the sealing strips 20, 22 and 24 in sealing contact with the piling 12 and the jacket 10.

In accordance with the teachings of the present invention, the jacket 10 is provided with three lower inlet ports 52 which are positioned adjacent the lower edge 18 of the jacket 10 and equally spaced around the jacket 10. Each port 52 includes a quick-connect female coupling member of a quick-connect coupling assembly which is of conventional type and which includes a one way check valve therein. Thus, when the coupling assembly is disconnected the ports 52 are closed and when a male coupling member is coupled with the female coupling member forming part of each port 52 the one way check valve in each port 52 allows fluid material to be injected into the annular space 50 but prevents "outflow" or "backflow" through the port 52.

Also the jacket 10 is provided with three venting ports or outlet ports 54 which are situated in the jacket adjacent the upper edge 20 and equally spaced around the jacket 10. Each of the venting or outlet ports 54 has a manually manipulatable valve therein with a movable valve controlling element 56 in the form of a wing.

As shown in FIG. 1, the outlet ports 54 can be located directly above the inlet ports 52 or as shown in FIG. 3, the outlet ports 54 can be staggered from the inlet ports 52.

In practicing the method of the present invention utilizing the underwater injection jacket 10, a diver will spread the mating edges 26 and 28 of the coiled sheet 14 apart to place the jacket over a portion of a piling such as the piling 12 which is to be restored and rehabilitated. Then, the diver will place the rods 34 in the notches 46 and the wing nuts 38 are tightened down to draw the mating edge portions 26 and 28 into an overlapping position as shown in FIG. 3 thereby to securely clamp the jacket 10 in place.

Once the jacket 10 is firmly secured in place about a portion of the piling 12, three tubings or conduits 71–73 each having a male quick-connect coupling 74 at the end thereof for mating with and coupling with the quick-connect coupling of the ports 52 for forming the quick-connect coupling assembly are inserted into the quick-connecting coupling/ports 52.

The other ends of the tubings 71–73 are coupled by two T connectors 76 and 78 to the outlet of a conventional resin injection gun 80. The injection gun 80 has a hand manipulatable trigger 82 and is coupled by a tubing 84 to a source of epoxy resin composition which is typically located at the surface on the pier or adjacent boat. The sheet 14 can be of a clear plastic material or can be pigmented. If it is of clear plastic material, the diver may be able to see the flow of epoxy resin composition into the annular space 50. In this respect, the epoxy resin composition is typically a white colored material.

Prior to injecting the epoxy resin composition into the annular space, the wings 56 are manipulated to open each one of the ports 54 so that as epoxy resin composition is injected into the annular space 50 it extrudes the water from the annular space and forces the water out through the ports 54.

The epoxy resin composition utilized in restoring and rehabilitating the wood, concrete or steel piling 12 is a special epoxy resin of the type disclosed in U.S. Pat. No. 4,221,890 issued on Sept. 9, 1980 for: EPOXY RESIN COMPOSITION AND METHOD FOR MAKING SAME, the disclosure of which is incorporated herein by reference.

As brought out in this patent, the epoxy resin composition disclosed and claimed therein will cure at very low temperatures and at least as 0° F. for a dry substrate on which it is applied and at a temperature of at least 33° F. for a wet substrate to which it is applied.

More specifically and as disclosed in the patent referred to above, such epoxy resin composition is a low viscosity, 100% solids epoxy-amine compound which is workable and cures at a temperature at least as low as 0° F. and at least as high as 140° F., which is particularly adapted for concrete rehabilitation and preservation and which comprises an epoxy resin having a plurality of 1,2 epoxy groups and a curing agent including a first aliphatic polyamine composition, a first accelerator comprising Bisphenol-A, a second polyamine composition, and a second accelerator selected from a group comprising N-aminoethylpiperazine, nonyl phenol and tris (dimethylaminomethyl) phenol.

Specific epoxy resin composition formulations are set forth in the patent referred to above.

The epoxy resin composition is injected into the annular space 50 until the operator, namely an underwater diver, notices the epoxy resin composition exiting out of the ports 54. At this time, he releases the trigger 82 and closes the valves in the ports 54 by manipulating the wings 56 forming the control element for the valves. Then, the couplings 74 are removed from the ports 52 which automatically close because of the one way check valves therein and the jacket is left in place to allow the epoxy resin to cure and seal the cracks on the surface of the piling 12.

In some situations, the wood or concrete piling 12 may have cracks extending substantially into and through the piling or other underwater structure to be rehabilitated and restored. In such circumstances, it is desirable to fill the cracks within the piling with the epoxy resin composition. For this type of rehabilitation and restoration of a wood or concrete piling another embodiment of the underwater injection jacket of the present invention is utilized and such underwater injection jacket is illustrated in FIGS. 5, 6 and 7 and generally identified by the reference numeral 110.

The underwater injection jacket 110 is adapted to be fitted around and secured around a wood or concrete piling such as a concrete piling 112 shown in FIG. 5 which has cracks 113 (FIG. 6) which extending through the piling 112.

In this embodiment, the jacket 110 is made from a sheet of flexible, clear or pigmented, plastic material such as ABS, PBC or plexiglass. A sealing strip 116 is secured to the inner surface of the sheet 114 adjacent the bottom edge 118 of the sheet/jacket 110 by a conventional epoxy resin composition and another sealing strip of foam material 120 is secured to the inner surface of the sheet 114 adjacent the top edge 122 of the sheet/jacket 110 by a conventional epoxy resin composition.

In addition to the lower strip 116 and upper strip 120 of sealing material which form sealing rings when the sheet 110 is coiled around the piling 112, the jacket 110 also includes a first elongate sealing strip 124 which extends between the top and bottom edges 122 and 118 adjacent a first mating edge 126 and adhered by a conventional epoxy resin composition to the inner marginal surface area of the sheet 114 adjacent the mating edge 126 as best shown in FIG. 6.

As with the jacket 10, the jacket 110 has a second mating edge 128 of the sheet 114 which extends over and overlaps the first mating edge 126 and the margin adjacent thereto. Also a clamping system 130, in this case a clamping system identical to the clamping system 30 shown in FIG. 1, is mounted on the marginal surface areas adjacent the edges 126 and 128 for drawing the edges together and securing them in place relative to each other as shown in FIG. 6.

In this embodiment of the jacket 114 a second sealing strip 132 is secured to the inner surface of the sheet 114 at a position diametrically opposite the strip 124 and extends between the bottom edge 118 and top edge 122 of the sheet/jacket 110. This sealing strip 132 is secured to the sheet 114 by a conventional epoxy resin composition.

All of the sealing strips, 116, 120, 124 and 132, are preferably made of a compressible foam material such as polyethylene or ethylenevinyl acetate. Also, the inwardly facing surfaces of these sealing strips, i.e., those surfaces which will engage the piling 112, are coated with the special epoxy resin which sets, bonds and cures to wet substrates at temperatures at least as low as 33° F. prior to the installation of the jacket 110 around the piling 112.

With the two elongate strips 124 and 132 secured to and between the sheet 114 and the piling 112 the jacket 110 when mounted on the piling 112 and adhered thereto by the special epoxy resin composition creates a bifurcated annular space, namely first and second semi-annular space portions 141 and 142 on opposite sides of the piling 112 as best shown in FIG. 6. The first semi-annular space portion 141 is referred to as positive pressure space 141 and the second semi-annular space portion 142 is referred to as a negative pressure space 142 for reasons which will be described in greater detail hereinafter.

As shown in FIGS. 6 and 7, the jacket 110 is provided with four inlet ports 152 identical to the inlet port quick-connect female coupling members 52 shown in FIG. 1 located adjacent the bottom edge 118 of the sheet/-jacket 110 and four upper outlet ports 154 situated adjacent the upper edge 122 of the sheet/jacket 110. The outlet ports 154 each have a manually manipulatable valve associated therewith including a movable valve control element or wing 155.

The inlet ports 152 and the outlet ports 154 are located at equidistant positions about the circumference of the jacket 110 with the outlet ports 154 located above the inlet ports 152. Also, two inlet ports 152 provide inlets to the positive pressure space 141 and the other two inlet ports 152 provide inlets and outlets to the negative pressure space 142. Likewise, two of the outlet ports 154 provide outlets from the positive pressure space 141 and the other two outlet ports 154 provide outlet ports from the negative pressure space 142.

In practicing another embodiment of the method of the present invention for not only encapsulating a concrete or wood piling such as the piling 112 but also for sealing the cracks 113 that extend through the piling 112 the injection of an epoxy resin composition into the jacket 110 is accomplished in the following manner.

First of all, two tubings 162 and 164 are connected to a T 168 leading to an injection gun (not shown) similar to the gun 80 shown in FIG. 1. These two tubings 162 and 164 have male quick-connect coupling members at the end thereof adapted to be received in and coupled to the quick-connect coupling female members forming part of the inlet ports 152 into the first semi-annular space portion/positive pressure space 141. This is done, of course, after the jacket 110 has been assembled about the piling 112 and the sealing members 116, 120, 124 and 132 have been adhered to the column by the special epoxy resin composition which, of course, would be allowed to set, cure and bond prior to injecting epoxy resin composition into the positive pressure space 141. Typically, what is done is that the jacket 110 is mounted on the piling 112 one day and then the method for injecting epoxy resin composition into the semi-annular space portions 141 and 142 to encapsulate that portion of the piling 112 and also fill and bond the cracks 113 therein is performed.

Continuing with the practice of the method after the tubings 162 and 164 have been connected to the inlet ports 152 at the lower end of the positive pressure space 141, the upper outlet ports 154 are opened to allow water to be forced out of the space 141.

At the same time, tubings 171 and 172 are coupled to the inlet ports 152 to the second semi-annular space portion or negative pressure space 142. These tubings are connected to a source of vacuum 174.

The outlet ports 154 from the second semi-annular space portion 142 are also connected by two tubings 175 and 176 respectively to the source of vacuum 174. With these tubing connections, the method is practiced by first injecting a special epoxy resin composition of the type described above which is capable of setting, curing and bonding at temperatures as low as 33° F. into the positive pressure space 141 while at the same time drawing a vacuum on all the ports communicating with the negative pressure space 142. At the same time, the upper outlet ports 154 coupled to the positive pressure space 141 are vented so that water can be extruded from the space 141 as epoxy resin composition is injected therein.

When an operator, such as an underwater diver, notices epoxy resin escaping from the upper ports 154 coupled to the positive pressure space 141, he then closes the valve elements in the ports 154.

Epoxy resin continues to be injected into the positive pressure space 141 while a vacuum is drawn on all the ports coupled to the negative pressure space 142 until epoxy resin composition is noticed exiting from the negative pressure space 142. This is accomplished by reason of the tubings 171, 172, 175 and 176 being made of a clear plastic material and epoxy resin composition being white in color. Thus, when these tubings show white material therein, the underwater diver will then know that the tubings 171 and 172 connected to the inlet ports 152 of the negative pressure space 142 should be disconnected and then two other tubings, not shown, leading from the injection gun, not shown, are coupled to the inlet ports 152 to the negative pressure space 142 so that epoxy resin composition can be injected into both spaces while still drawing a vacuum on the upper outlet ports 154 coupled to the negative pressure space 142.

Epoxy resin composition continues to be injected into both spaced 141 and 142 until such epoxy resin composition is observed escaping from both of the upper outlet ports 154 communicating with the negative pressure space 142. Then, the ports 154 are closed and all the tubings connected to the ports 152 are disconnected and by reason of the one way check valves in such ports 152, they are also closed.

The epoxy resin composition is then allowed to set, cure and bond. Also, the jacket, 10 or 110, being made of an inexpensive material, is allowed to stay in place on the piling to provide even further protection to the piling. In this way, the piling 12 or 112 made of wood, concrete or steel, is rehabilitated and restored and cracks therein cemented to restore the structural integrity of the piling. When the piling and the cracks therein are coated with various organic and inorganic materials such as algae and sediment, it may be desirable to clean off the surface first. In such case, a surfactant or air can be first introduced into the annular space or annular space portions to clean off the surfaces to be encapsulated and bonded. In this modification of the method of the present invention, either air or surfactant can be passed through the annular space or annular space portions prior to performing the other steps of the methods described above.

Further, one may wish to first pass a surfactant through the annular space or semi-annular portions and then purge the annular space or space portions with air followed by the injection of epoxy resin composition into the annular space or annular space portions.

Also it will be understood that the preferred epoxy resin composition to be injected into the jacket 10 or 110 is of the type disclosed in U.S. Pat. No. 4,221,890 referred to above.

Referring now to FIGS. 8, 9 and 10, there is disclosed therein another embodiment of the underwater injection jacket of the present invention which is generally identified therein by reference numeral 210. The underwater injection jacket 210 is substantially identical to the underwater injection jackets 10 and 110 except for the manner in which the sheet 214 is secured in place around a column or piling 216 which in this embodiment has a hexogonal cross section. In this respect, the sheet 214 has a first mating edge 226 and an adjacent margin 227 which are received under the second mating edge 228 and adjacent margin 229 as shown in FIGS. 9 and 9A. Also, as best shown in FIG. 9A, a lower sealing strip 230 which is secured to the inner surface of the sheet 214 adjacent the lower edge 232 of the jacket 210 extends from the inner edge 226 in a counterclockwise direction around, adjacent to and secured to the inner surface of the sheet 214 to a point spaced from the second mating edge 228. In this way, the first mating edge with the sealing ring terminating thereat are both received under the second mating edge 228 and adjacent margin 229.

Also in this embodiment of the jacket 210, an over-center toggle locking action type clamping system 240 is utilized. As shown in FIGS. 9 and 10, the clamping system 240 includes a first elongate bar of angle iron 242 which is secured to the margin 227 at a point spaced behind the first mating edge 226. A lever arm assembly 244 comprising first and second lever arms 246 and 248 and a connecting bar 250 are pivotally connected to the bar of angle iron 242.

A second bar of angle iron is secured to the margin 229 such that the outwardly extending portion of the bar of angle iron 252 extends flush with the second mating edge 228 as shown in FIG. 10.

Pivotally connected to each of the lever arms 246 and 248 is a U shaped rod 256 or 258. Each U shaped rod 256 and 258 has two leg portions such as the leg portion 260 shown in FIG. 10. This leg portion has a threaded outer end 262 for holding a spring and stop assembly 264 on the leg 260. The stop and spring assembly includes a spring 266 which extends between a washer 268 adjacent the nut 262 and a stop member 270.

The leg portion 260 is adapted to be received in a slot in the bar 252 such as the slot 272 shown in FIG. 11 having an inlet portion 273 and a notch retaining portion 274. In this embodiment the rod is received through the inlet portion 273 and then moved into the retaining notch portion 274. In this embodiment the stop 270 can take the form of a washer on the rod leg 260 or could take the form of a short strap which extends to the other leg of the two legs of the U shaped rod 256 to form a stop of the spring and stop assembly 264 mounted on that leg also.

Figure 2:
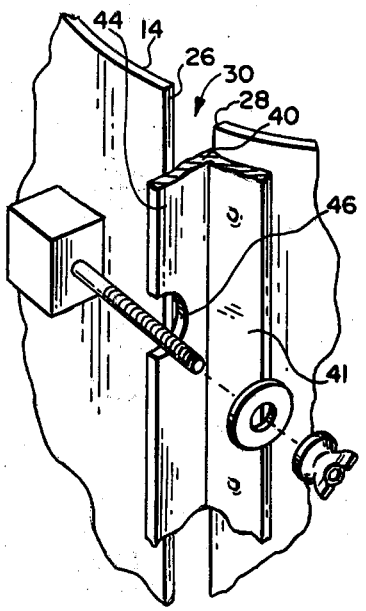
FIG. 2 is an enlarged fragmentary view of the clamping system utilized for clamping the mating edges of the flexible sheet from which the jacket is formed in place to form the jacket around the piling in FIG. 1.

When the stop 270 takes the latter form as shown in FIG. 12, the slot in the bar in this case, slot 280, can have a generally U shape and the bar 252 can have an aperture 282 therein adjacent the slot 280. Then a detent 284 (FIG. 10) is punched out of the strap 270 and is adapted to be received through the aperture 282 when the U shaped rods 256 and 258 of the clamping system 240 are moved into the slots 280 for positioning the stop 270 behind the upright portion of the bar of angle iron 252 as shown in FIG. 2. Then the lever arms 246 and 248 are rotated from an outer position to an inner position adjacent the jacket 210 to cause the spring 266 and stop member 270 to bear against the upright portion of the bar of angle iron 252 to draw the second mating edge 228 over the margin 227. At this time, the detent 284 is received in the aperture 282 to prevent outward movement of the rods 246 from the slots 280.

It will be understood that in utilizing the clamping assembly 240 the lever arms 246 and 248 are first moved to an extended outer position and the second mating edge 228 is brought into position over the first mating edge 226 and margin 227. Then the rod legs such as leg 260 are received in the slots 272 or 280 and the stop member 270 brought into position to bear against the upright portion of the bar of angle iron 252. The rod legs 260 are either received in the retaining notch portions 274 or the detent 284 is received in the aperture 282 (FIG. 11 or FIG. 12) to ensure releasable locking of the rod legs 260 in the slots 272 or 280. Then the lever arm assembly 244 is rotated inwardly toward the jacket 214 to cause the bight portion of the U shaped rods 256 and 254 to travel through an arcuate over-center path so as to create an over-center toggle locking action when the lever arms 246 and 248 are brought flush against the outer surface of the jacket 210. Then to ensure that the lever arms 246 and 248 are not accidentally allowed to move outwardly from the jacket 214, a spring latch member 290 (FIG. 9) is hooked over the arm or bar 250 to hold the clamping system in a releasably locked position. As shown in FIG. 10, each lever arm 246 and 248 has a plurality of openings, namely four, for receiving a bight of U-shaped rod 256 or 258. The opening chosen determines the amount of compression placed on the spring 266 in drawing the overlapping mating edge portions 226 and 228 together in an overlapping relationship thereby to provide adjustment of the compression force applied.

The clamping system 240 and modifications thereof described above do not require the handling of any nuts or bolts which if dropped underwater could cause a problem. Yet at the same time, the clamping system 240 permits an easy and simple clamping of the mating edges 226 and 228 in overlapping relationship relative to each other and with the jacket 214 firmly clamped about the piling 216.

From the foregoing description it will be apparent that the underwater injection jacket 10, 110 or 210 of the present invention and the method for utilizing same to encapsulate or encapsulate and fill cracks within a piling made of wood, concrete or steel, has a number of advantages some of which have been described above and others of which are inherent in the invention.

Also it will be apparent from the foregoing description that many modifications can be made to the underwater injection jacket and the method of the present invention without departing from the teachings of the invention. In this respect, the sheet of plastic material from which the jacket is made, i.e., sheet 14, 114 or 214, can be made of other materials besides plastic. Preferably it has a dimension of 0.060 inch. Also such sheet can have a variety of dimensions. In this respect, the sheet can be of any desired length with a preferred length being between 1 foot and 8 feet, such as 2 or 3 feet in length. Also, when it is longer than 3 feet, additional clamping members or clamping rods can be utilized and additional inlet and outlet ports can be provided in the jacket.

Still further, the width of the sheet 14, 114, or 214, i.e., the circumferential extent of the sheet, can be sized to accommodate the particular piling. This width or circumferential extent can be up to five feet or more.

Also, although strips of foam material are utilized with the jackets 10, 110 and 210 for sealing the annular space 50, or 141 and 142 between the jacket 10, 110 or 210 and the piling 12, 112 or 216, other sealing or gasket materials could be utilized.

Still further, although two clamping systems 30 and 240 have been described above, it is to be understood that other forms of clamping systems can be utilized provided they provide a simple mechanism for clamping the mating edges of the sheet 14, 114 or 214 without the use of detached small pieces such as nuts or bolts which could easily be dropped and lost by a diver underwater.

Since many modifications can be made to the underwater jacket and method of the present invention as described in some detail above without departing from the teachings of the present invention, the scope of the invention is only to be limited as necessitated by the accompanying claims.

I claim:

1. A method for restoring an underwater concrete, wood or steel piling or other underwater structure including the steps of: placing a sheet of plastic material around a portion of a piling to be restored with longitudinal edges of the sheet overlapping each other and with at least one strip of compressible material situated between the lower edge of the sheet and the piling; applying an epoxy composition either to the inner surface of the strip of compressible material and/or the adjacent piling; drawing the longitudinal edges of the sheet in further overlapping relationship; fixing the drawn together edges in place to form a jacket around the piling and to create an annular space between the piling and the jacket; injecting an epoxy composition into said annular space while at the same time venting said annular space in at least one location at the upper end of said annular space until said epoxy composition begins to escape from said at least one location at the upper end of said annular space.

2. The method according to claim 1 being used for restoring a concrete or wood piling.

3. The method according to claim 2 being used for sealing cracks in the concrete or wood piling and for restoring, at least in part, the structural integrity of the concrete or wood piling.

4. The method according to claim 1 wherein said epoxy composition is injected in at least three locations into said annular space at the lower end of said annular space.

5. The method according to claim 1 wherein said annular space is vented at the upper end of said annular space in at least three locations into the ambient water environment.

6. The method according to claim 1 wherein said injection of epoxy composition into said annular space is manually controlled.

7. The method according to claim 1 wherein said injection of epoxy composition into said annular space is controlled relative to the monitoring of the escape of epoxy resin from the upper end of said annular space.

8. The method according to claim 1 including the step of first purging said annular space with air prior to injecting epoxy composition into said annular space.

9. The method according to claim 1 including the step of first passing a surfactant through said annular space to wash or clean the exposed piling surrounded by the jacket.

10. The method according to claim 9 including the step of purging said annular space with air after passing a surfactant through said annular space and prior to injecting said epoxy composition into said annular space.

11. The method according to claim 1 wherein said epoxy resin composition is a low viscosity, 100% solids epoxy-amine composition which is workable and cures at a temperature at least as low as 33° F. and at least as high as 140° F., which is particularly adapted for concrete rehabilitation and preservation and which comprises an epoxy resin having a plurality of 1,2 epoxy groups and a curing agent including a first aliphatic polyamine composition, a first accelerator comprising Bisphenol-A, a second polyamine composition, and a second accelerator selected from the group comprising N-aminoethylpiperazine, nonyl phenol, and tris (dimethylaminomethyl) phenol.

12. The method of claim 1 including the steps of: also placing a strip of compressible material between the upper edges of the sheet and the piling; and applying an epoxy composition either to the inner surface of the strip and/or to the adjacent piling prior to drawing the edges of the sheet in overlapping relationship.

13. The method according to claim 12 wherein said annular space is closed at the top and bottom thereof by said strips of compressible material and said venting of said upper end of said annular space between said jacket and the piling is stopped when epoxy composition begins to escape from the upper end of said annular space, wherein said epoxy composition is injected into the lower end of said annular space and the injection of epoxy composition is stopped after said venting is stopped, and wherein said method includes the further step of closing, in a sealed manner, inlet and outlet ports to and from said jacket which permit said injection of epoxy composition into said annular space and said venting of water from said annular space.

14. The method according to claim 13 wherein the outlet ports are closed by moving a valve controlling element for each outlet port in said jacket at the upper end of said annular space from an open position to a closed position.

15. The method according to claim 13 wherein said inlet ports are closed by reason of disconnection of a quick-connect coupling at the end of an epoxy composition injection tubing from a mating quick-connect coupling at each inlet port in the jacket at the lower end of the annular space, with each quick-connect coupling in each inlet port having a one way check valve therein.

16. The method according to claim 12 wherein said jacket includes first and second sealing means for establishing first and second compressible closed semi-annular space portions within said annular space and has at least one lower inlet to each semi-annular space portion and at least one upper outlet from each semi-annular space portion, and wherein said steps of injecting epoxy composition into said jacket and venting said jacket includes the steps of: injecting epoxy composition into the at least one lower inlet at the lower end of said first semi-annular space portion, venting said first semi-annular space portion through the at least one upper outlet from said first semi-annular space portion; drawing a vacuum on the at least one upper outlet from and on the at least one lower inlet to said second semi-annular space portion until epoxy composition is sensed exiting from said upper outlet of said first semi-annular space portion; subsequently closing the at least one outlet from the upper end of said first semi-annular space portion; continuing injecting epoxy composition into said first semi-annular space portion and continuing to draw a vacuum on the lower inlet to and upper outlet from said second semi-annular space portion until epoxy composition is sensed escaping from the inlet to or outlet from said second semi-annular space portion; stopping the drawing of a vacuum on the at least one lower inlet to said second semi-annular space portion; injecting epoxy composition through the at least one lower inlet to said second semi-annular space portion while continuing to inject epoxy composition into said first semi-annular space portion and drawing a vacuum on the at least one upper outlet from said second semi-annular space portion until epoxy composition is sensed escaping from said at least one upper outlet from said second semi-annular space portion; and, then closing said at least one upper outlet from said second semi-annular space portion and stopping the injection of epoxy composition into said annular space portions.

17. The method according to claim 16 wherein said jacket has two lower inlets to and two upper outlets from each semi-annular space portion.

18. The method according to claim 16 including the further step of first injecting air into said first semi-annular space portion while drawing a vacuum on said second semi-annular space portion.

19. The method according to claim 16 including the further step of first injecting a surfactant into said first semi-annular space portion while drawing a vacuum on said second semi-annular space portion.

20. The method according to claim 16 including the further steps of first injecting a surfactant into said first semi-annular space portion while drawing a vacuum on said second semi-annular space portion followed by injecting air into said first semi-annular space portion while continuing to draw a vacuum on said second semi-annular space portion followed by the injection of epoxy composition into said first semi-annular space portion and the other steps defined in claim 14.

21. The method according to claim 16 wherein said sealing means include first and second elongate strips of compressible material which extend axially of the jacket on opposite sides of the piling and upper and lower rings of compressible material, the strips and rings being adhered in a vacuum tight manner to the inner surface of the jacket and wherein said method includes the initial step of applying said epoxy composition to the inwardly facing surface of the strips and rings when installing the jacket to establish a bond and seal between the strip and rings and the piling; and allowing such resin to cure, set and bond for a sufficient period of time prior to injecting epoxy composition into the first semi-annular space portion.

22. An underwater injection jacket comprising a sheet of flexible plastic material having an upper edge and a lower edge and which is coilable into a jacket around an underwater piling with first and second mating and overlapping edges of said sheet adapted to be secured in place in overlapping relationship relative to each other to form said jacket about the piling, first compressible sealing means along said lower edge of said sheet for establishing a lower annular seal between said jacket formed by said sheet and the piling when said mating edges are secured in place in overlapping relationship relative to each other thereby to form an annular space within said jacket, clamping means for clamping said mating edges in place in overlapping relationship relative to each other and in a sealed manner, said clamping means comprising adjustable spring biased means for drawing the opposed longitudinal edges of the sheet of plastic material together in overlapping relationship to each other and means for securing the drawn together overlapping edges in place.

23. The jacket according to claim 22 including an elongate compressible sealing member which is fixed to a margin of said sheet adjacent one of said mating edges and which is adapted to bear against the piling when said mating edges are secured in place relative to each other.

24. The jacket according to claim 22 wherein said first compressible sealing means is made of a strip of foam material such as polyethylene or ethylenevinyl acetate.

25. The jacket according to claim 22 wherein said securing means include a first bar of angle iron fixed to the margin of said sheet adjacent said second mating edge, a second bar of angle iron fixed to the first margin and having a threaded rod extending therefrom, one side of said first bar of angle iron and one side of said second bar of angle iron each having a plurality of slots equal in number to said rods, each slot being adapted to receive one of said rods therein, and a threaded fastener received on the end of each rod for drawing together and securing said bars of angle iron together in a fixed relationship to each other.

26. The jacket according to claim 25 wherein said margin adjacent said first mating edge is received under the margin adjacent said second mating edge and wherein said jacket incluees an elongate compressible strip of foam material fixed to the inside surface of said sheet at the margin of said sheet adjacent said first mating edge and extending between said upper and lower edges of said sheet.

27. The jacket according to claim 25 wherein each of said slots in said first and second bars of angle iron have an L shape so as to have an inlet portion and a retaining notch portion whereby a rod end can be moved first through the inlet portion and second into the retaining notch portion when the clamping system is manipulated.

28. The jacket according to claim 25 wherein each of said fasteners is a wing nut positioned on the end of one of said threaded rods.

29. The jacket according to claim 22 wherein said adjustable spring biased drawing means comprises a first bar of angle iron fixed to the margin of said sheet and spaced from said first mating edge to a second bar of angle iron fixed to the margin of said sheet at or adjacent said second mating edge, a lever arm assembly pivotally connected to said first bar, at least two rods pivotally connected to said lever arm assembly, the outer end of each rod having a spring assembly mounted thereon between a first stop fixed to the distal end of the rod and a second stop movable on said rod, said second bar having at least two slots therein, each rod being adapted to be received in one of said slots when said lever arem assembly is in an outer position away from said jacket, said second stop being positioned adjacent said second bar and said spring being adapted to be compressed to cause drawing of one margin adjacent one mating edge toward and over the other margin adjacent the other mating edge in a sliding movement when the lever arm assembly is moved toward said jacket through an overcenter path of the end of the rod connected thereto to compress said spring and latch said lever arm assembly in a toggle locking action thereby to bring said mating edges to a position relative to each other where they are secured in place.

30. The jacket according to claim 22 wherein said sheet of flexible material is made from a material taken from the class consisting of ABS, PVC and plexiglass.

31. The jacket according to claim 22 wherein said jacket is made from a sheet of flexible clear plastic material.

32. The jacket according to claim 22 having a thickness of approximately 0.060 inch.

33. The jacket according to claim 22 having a length of from approximately 1 foot to approximately 8 feet.

34. The jacket according to claim 29 wherein each slot has a generally L shape with an inlet portion and a retaining notch portion and each rod is adapted to be received through the inlet portion and then positioned in the retaining notch portion to releasably lock said rod and spring member in place.

35. The jacket according to claim 29 wherein each slot has a generally U shape, said bar has at least one aperture therein adjacent said slot, and said second stop has edge portions which engage said second bar adjacent said slot and a detent in an edge portion which is received in said aperture to releasably lock said rod and spring assembly in place.

36. The jacket of claim 29 wherein said lever arm assembly has a plurality of openings each adapted to receive one end of one of said rods, the opening chosen determining the amount of compression force applied to said spring and said openings permitting adjustment of the spring compression force.

37. The jacket of claim 22 including a second compressible sealing means along said upper edge of said sheet for establishing an upper annular seal between said jacket formed by said sheet and the piling when said mating edges are secured in place in overlapping relationship relative to each other thereby to form a closed annular space within said jacket.

38. The jacket according to claim 37 including inlet means comprising at least two inlet ports each having a quickconnect coupling member fixed thereto with a one way check valve in each coupling member and with each port being located adjacent the lower edge of said sheet/jacket.

39. The jacket according to claim 38 including three inlet ports.

40. The jacket according to claim 38 including four inlet ports.

41. The jacket according to claim 37 including outlet means comprising at least two outlet ports adjacent the upper edge of said sheet/jacket, each outlet port having a valve therein and each valve having a manually manipulatable valve element for opening and closing said outlet ports.

42. The jacket according to claim 41 including three outlet ports.

43. The jacket according to claim 41 including four outlet ports.

44. The jacket according to claim 37 wherein said first and second compressible sealing means are made of a foam material such as polyethylene or ethylenevinyl acetate and said jacket includes an elongate sealing strip being made of a foam material such as polyethylene or ethylenevinyl acetate and being secured to the margin adjacent one of said mating edges facing the piling and extending between the upper and lower edges of said sheet/jacket for forming a seal between the piling and the margin.

45. The jacket according to claim 44 including a second elongate sealing strip made of foam material such as polythelene or ethylenevinyl acetate, said second elongate sealing strip being secured to the inner surface of said sheet opposite said first elongate sealing strip and extending between the upper and lower edges of said sheet/jacket to divide the annular space into first and second semi-annular space portions.

46. The jacket according to claim 45 wherein said inlet means include at least two inlet ports on each side of said jacket adjacent the lower edge thereof for each of said semi-annular space portions and wherein said outlet means include at least two outlet ports on each side of said jacket adjacent said upper edge thereof for each of said semi-annular space portions.

* * * * *